US008893521B2

(12) United States Patent
Baek

(10) Patent No.: US 8,893,521 B2
(45) Date of Patent: Nov. 25, 2014

(54) MULTI-COOLING MODULE FOR VEHICLE

(75) Inventor: Seung Jin Baek, Gyeonggi-do (KR)

(73) Assignee: Hyundai Motor Company, Seoul (KR)

( * ) Notice: Subject to any disclaimer, the term of this patent is extended or adjusted under 35 U.S.C. 154(b) by 908 days.

(21) Appl. No.: 13/077,289

(22) Filed: Mar. 31, 2011

(65) Prior Publication Data

US 2012/0132401 A1 May 31, 2012

(30) Foreign Application Priority Data

Nov. 25, 2010 (KR) ..... 10-2010-0118413
Nov. 25, 2010 (KR) ..... 10-2010-0118414

(51) Int. Cl.
*B60H 1/32* (2006.01)
*F28D 15/02* (2006.01)
*F01P 3/22* (2006.01)

(52) U.S. Cl.
CPC ..... *F28D 15/0275* (2013.01); *F01P 2003/2278* (2013.01)
USPC ..... 62/239; 165/104.13; 165/104.21; 165/104.33

(58) Field of Classification Search
CPC ..... F25D 15/0233; F25D 15/0275
USPC ..... 165/104.13, 104.14, 104.21, 104.33
See application file for complete search history.

(56) References Cited

U.S. PATENT DOCUMENTS

| | | | | |
|---|---|---|---|---|
| 2005/0072176 | A1* | 4/2005 | Albertson | 62/259.2 |
| 2006/0168991 | A1* | 8/2006 | Harm | 62/434 |
| 2007/0079622 | A1* | 4/2007 | Bradley et al. | 62/244 |
| 2007/0184320 | A1 | 8/2007 | Domen | |

FOREIGN PATENT DOCUMENTS

| | | | |
|---|---|---|---|
| JP | 05231147 | A | 9/1993 |
| JP | 08200973 | A | 8/1996 |
| JP | 09013963 | A | 1/1997 |
| KR | 10-0427932 | | 4/2000 |
| KR | 10-2008-0019952 | | 3/2008 |
| KR | 10-2010-0059490 | | 6/2010 |

* cited by examiner

*Primary Examiner* — Cassey D Bauer
(74) *Attorney, Agent, or Firm* — Edwards Wildman Palmer LLP; Peter F. Corless

(57) ABSTRACT

The present invention relates to a multi-cooling module for a vehicle, and more particularly to a multi-cooling module adapted to simultaneously cool an engine, electric parts, and a condenser through one or more heat pipes. In the multi-cooling module for a vehicle, one or more heat pipes are mounted to pass through two or more refrigerant passage pipes which go through with the same cooling system core unit.

12 Claims, 6 Drawing Sheets

MULTI-COOLING MODULE FOR VEHICLE

CROSS-REFERENCE TO RELATED APPLICATION

This application claims under 35 U.S.C. §119(a) the benefit of Korean Patent Application Nos. 10-2010-0118413 and 10-2010-0118414 both filed Nov. 25, 2010, the entire contents of which are incorporated herein by reference.

BACKGROUND (a) Technical Field

The present invention relates to a multi-cooling module for a vehicle. More particularly, it relates to a multi-cooling module adapted to simultaneously cool an engine, electric parts, and a condenser through one or more heat pipes.

(b) Background Art

In recent years, hybrid vehicles have been developed that generate much heat as compared with internal combustion engine vehicles, and thus require a high level of cooling performance to maintain the durability of electric parts including motors.

To achieve this, a conventional hybrid vehicle cooling apparatus includes a condenser, an electric part radiator, an engine radiator, and cooling fans. The electric part radiator is adapted to cool electric parts (e.g., a travelling motor), and is disposed in front of the engine radiator together with the condenser.

Referring to FIG. 1, the cooling apparatus 10 as shown includes an electric part radiator 12 disposed on the frontmost side with respect to the front side of the vehicle, a condenser 14 and an engine radiator 16 sequentially disposed at certain distances on the rear side of the electric part radiator 12, and a cooling fan 18 disposed on the rearmost side to suction cooling air.

The electric part radiator 12 and the condenser 14 perform cooling operations independently. Here, the condenser 14 provides a cooling function. The condenser 14 together with a compressor and an evaporator form a cooling system. The electric part radiator 12 functions to cool down cooling waters released from a junction box, various batteries, a controller, and a travelling motor. The engine radiator 16 functions to cool engine cooling water independently. However, the conventional cooling apparatus requires a cooling system core unit in the condenser 14, the engine radiator 16, and the electric part radiator 12, respectively. Therefore, such a conventional cooling apparatus takes up significant space, and thus, installation in a restricted installation space is not considered advantageous. This further results in an increase in manufacturing cost and weight.

SUMMARY OF THE DISCLOSURE

The present invention has been made in an effort to solve the above-described problems associated with prior art. The present invention generally provides a multi-cooling module for a vehicle. In particular, the present invention provides a multi-cooling module for a vehicle that satisfies reference cooling temperatures of refrigerants by properly adjusting the thicknesses of one or more pipes at sections where the refrigerants exchange heat with working fluid within at least one heat pipe. As such, simultaneous cooling of the refrigerants (e.g., cooling water) for an engine, electric parts, and a condenser is achieved through the heat pipe.

The present invention also provides a multi-cooling module for a vehicle in which refrigerant passage pipes are provided for the flow of an engine cooling refrigerant, an electric part cooling refrigerant, and a condenser refrigerant. In particular, the refrigerant passage pipes are concentrically stacked and arranged with heat pipes passing through their outer surfaces. As such, one or more heat pipes can simultaneously exchange heat with the engine cooling refrigerant, the electric part refrigerant, and the condenser refrigerant.

In one aspect, the present invention provides a multi-cooling module for a vehicle wherein one or more heat pipes are disposed so as to pass through two or more refrigerant passage pipes which pass through with the same cooling system core unit.

According to some embodiments, the refrigerant passage pipes may include a plurality of different passage pipes. For example, according to one preferred embodiment, the refrigerant passage pipes may include an engine refrigerant passage pipe, an electric part refrigerant passage pipe, and a condenser refrigerant passage pipe.

In some embodiments, the refrigerant passage pipes may be sequentially stacked and arranged from top to bottom in order of temperature, for example in order from a high temperature heat source to a low temperature heat source.

In some embodiments, the refrigerant passage pipes may be sequentially disposed based on temperature, particularly from the hottest one to the coldest one to be stacked and arranged.

According to some embodiments, different refrigerant passage pipes may contain different refrigerants.

According to some embodiments, when temperatures of outer surfaces of the heat pipes are reference cooling temperatures of respective refrigerants, temperatures of inner surfaces of the heat pipes may be an evaporation temperature of a working fluid in the heat pipes.

According to some embodiments, each heat pipe may have a different thickness at sections where the heat pipe passes through the refrigerant passage pipes for heat exchange.

In some embodiments, when a plurality of heat pipes are configured in the multi-cooling module, each heat pipe may have a different thickness at inlets and outlets of the respective refrigerant passage pipe.

According to embodiments of the present invention, an engine, electric parts, and a condenser can be simultaneously cooled with one or more heat pipes to form a single cooling system core section. Accordingly, installation of the present multi-cooling modules within a restricted installation space can be better facilitated and manufacturing cost and weight of the module can be reduced.

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g., fuels derived from resources other than petroleum). As referred to herein, a hybrid vehicle is a vehicle that has two or more sources of power, for example both gasoline-powered and electric-powered vehicles.

BRIEF DESCRIPTION OF THE DRAWINGS

The above and other features of the present invention will now be described in detail with reference to certain exemplary embodiments thereof illustrated the accompanying drawings which are given hereinbelow by way of illustration only, and thus are not limitative of the present invention, and wherein.

DETAILED DESCRIPTION

Hereinafter, an exemplary embodiment of the present invention will be described below in detail with reference to the accompanying drawings such that those skilled in the art to which the present invention pertains can easily practice the present invention.

Figure 2:
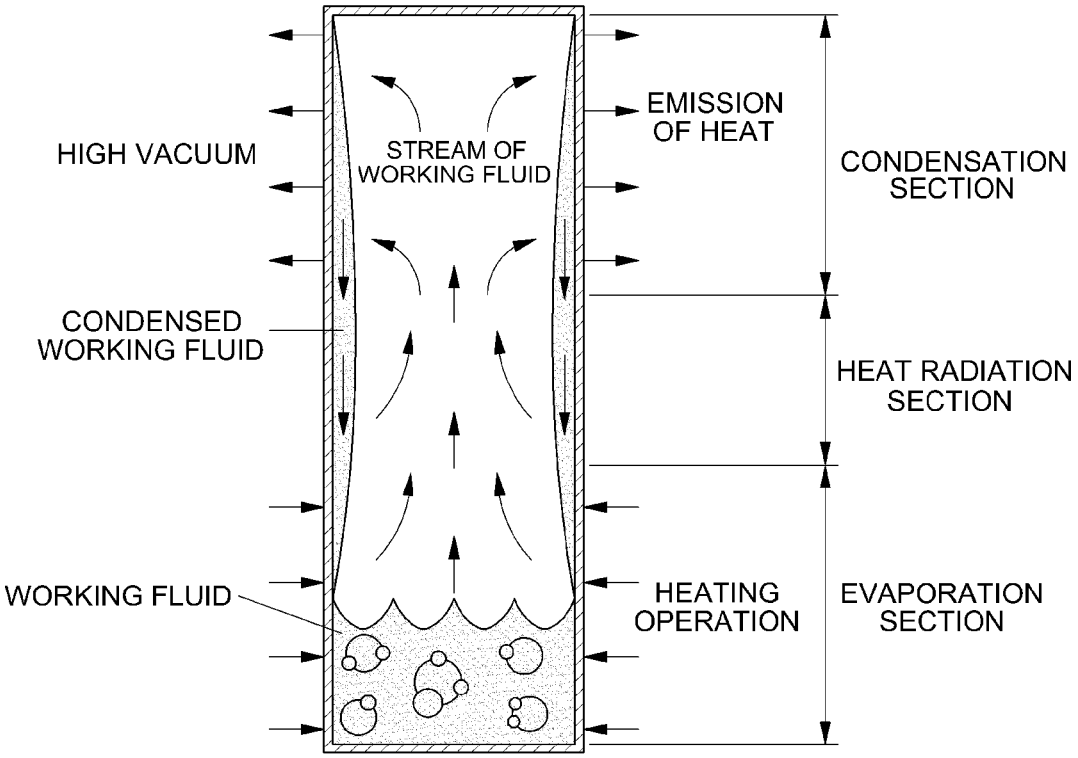
FIG. 2 is a conceptive view illustrating a heat exchange principle of a general heat pipe.

Referring to FIG. 2, which illustrates the structure and principle of a heat pipe, a material called a thermal medium or a working fluid is contained within the heat pipe. For example, water, mercury, methanol, and acetone are all materials that are considered thermal mediums or working fluids.

A conventional heat pipe is in the general form of a pipe (i.e. a hollow tubular structure) where a working fluid is contained, and the interior of the pipe is typically under vacuum. In the above heat pipe (e.g., as shown in FIG. 2), the liquid working fluid (which is typically of low boiling point) within the vacuum pipe is heated in an evaporator and then transported to a condenser. The working fluid then releases heat in the condenser, and is cooled down in a heat radiating unit in a convection manner. The thus cooled working fluid then returns to the evaporator to perform a cooling function on parts.

The heat pipe operated as such may be installed in heat radiating electronic parts, such as a CPU of a high-performance computer, or it may be installed in a refrigerator or an air conditioner as a heat exchanger to absorb heat.

According to an embodiment of the present invention, the refrigerant (e.g., cooling water) in engine refrigerant passage pipes 110, 111, electric part refrigerant passage pipes 120, 121, and condenser refrigerant passage pipes 130, 131 may be simultaneously cooled by passing through one or more heat pipes 140.

Figure 3:
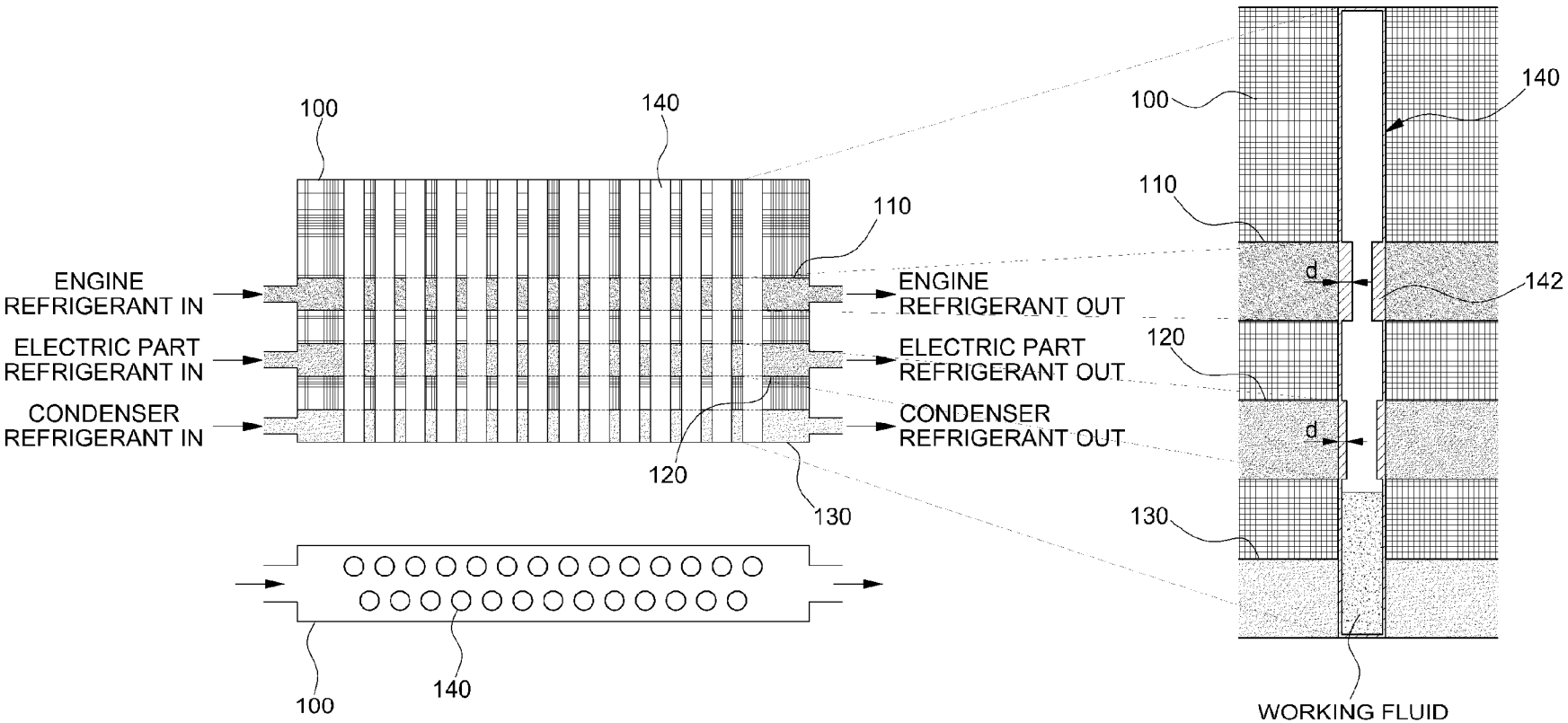
FIG. 3 is a schematic view illustrating a multi-cooling module for a vehicle according to an embodiment of the present invention.

For example, to achieve this, as illustrated in FIG. 3, a multi-cooling module according to an embodiment of the present invention includes a plurality of heat pipes 140 configured to simultaneously pass through the interiors of the engine refrigerant passage pipe 110, the electric part refrigerant passage pipe 120, and the condenser refrigerant passage pipe 130 which are arranged in parallel in three rows and connected to a same cooling system core unit 100.

That is, as illustrated in FIG. 3, the heat pipe 140 can be configured to simultaneously cross and pass through the engine refrigerant passage pipe 110, the electric part refrigerant passage pipe 120, and the condenser refrigerant passage pipe 130, which are arranged in parallel in a cooling system core unit (or heat radiating fin core unit), such that a refrigerant flows through the interiors of the refrigerant passage pipes 110, 120, and 130, whereby the refrigerant passing by the outer surface of the heat pipe 140 can be cooled.

In a conventional vehicle, an electric radiator, a condenser, and an engine radiator are conventionally disposed back and forth with respect to the front side of a vehicle. In the present invention, however, the engine refrigerant passage pipe 110, the electric part refrigerant passage pipe 120, and the condenser refrigerant passage pipe 130 are disposed from top to bottom with respect to the front side of a vehicle.

In particular, when considering the change in the state of the working fluid due to heat exchange of the heat pipe 140, the condenser refrigerant passage pipe 130 whose refrigerant has the lowest reference cooling temperature is located at a lower portion of the heat pipe 140. The electric part refrigerant passage pipe 120 and the engine refrigerant passage pipe 110 are sequentially arranged and stacked on the upper side of the condenser refrigerant passage pipe 130. This structure is then connected to the same cooling system core unit 100 configured to support the refrigerant passage pipes 110, 120, and 130.

According to embodiments of the present invention, the cooling system core unit 100 can have a structure through which exterior air can be introduced and discharged, and can further have a plurality of heat radiating fins which can maximize the heat transfer efficiency of the heat pipe 140.

For example, according to an embodiment of the invention, the heat pipe 140 and the refrigerant passage pipes 110, 120, and 130 can be configured to pass through and go by way of the cooling system core unit 100, whereby heat radiating fins of the cooling system core unit can come into contact with the heat pipe 140 and/or one or more of the refrigerant passage pipes 110, 120, and 130.

According an embodiment of the invention, at least one heat pipe 140 is configured in the cooling system core unit 100. Here, it is preferred that a plurality of heat pipes 140 be provided to increase heat exchange efficiency. For example, according to embodiments of the invention, a plurality of heat pipes 140 may be arranged in zigzags as illustrated in the cross-sectional view of FIG. 3, or in other suitable arrangements.

To enable the simultaneous cooling by the heat pipe 140 of the refrigerants contained in the engine refrigerant passage pipe 110, the electric part refrigerant passage pipe 120, and the condenser refrigerant passage pipe 130, which preferably all have different reference cooling temperatures, the pipe thickness at the sections of the engine refrigerant passage pipe 110, the electric part refrigerant passage pipe 120, and the condenser refrigerant passage pipe 130, where heat exchange is carried out, can be properly modified and adjusted. The evaporation temperature (e.g., 55° C.) of the working fluid for exchanging heat in the pipe 142 of the heat pipe 140 through state changes as a thermal medium remains constant. Therefore, the thickness of the pipes can be determined so that the temperature on the inner surface of the heat pipe 140 can be equal or similar to the evaporation temperature (boiling point) of the working fluid in the heat pipe 140, to meet the refrigerants in the refrigerant passage pipes 110, 120, and 130 which require different reference cooling temperatures.

In the multi-cooling module of the present invention, for example, the condenser refrigerant passage pipe 130 can be disposed in the evaporation section of the heat pipe 140. The electric part refrigerant passage pipe 120 and the engine refrigerant passage pipe 110 can then be sequentially arranged above the condenser refrigerant passage pipe 130, and, for example, can be located in the heat radiation section of the heat pipe 140. The condensation section of the heat pipe 140 can be exposed to the exterior air and/or connected to the cooling system core unit 100.

Preferably, when a plurality of heat pipes 140 are arranged in the cooling system core unit 100, each heat pipe 140 may have pipes 142 with different thickness at an inlet and an outlet through which the refrigerants of the refrigerant passage pipes 110, 120, and 130 travel.

Considering the temperature fluctuation of the refrigerants during heat exchange while flowing along the refrigerant passage pipes 110, 120, and 130, the heat pipe 140 disposed at the inlets of the refrigerant passage pipes 110, 120, and 130 may be designed in some embodiments to have a greater thickness than the heat pipe 140 disposed at the outlets of the refrigerant passage pipes 110, 120, and 130.

Hereinafter, in order to explain the operational state of the multi-cooling module according to an embodiment of the present invention, it is assumed that the reference cooling temperatures required by the engine refrigerant, the electric part refrigerant, and the condenser refrigerant are 100° C., 80° C., and 55° C., respectively.

With the assumption that the evaporation temperature of the working fluid of the heat pips 140 is 55° C., the working fluid is a liquid state of 55° C. at the evaporation section of the heat pipe 140. If the temperature of the condenser refrigerant is above 55° C., the temperature of the condenser refrigerant is decreased due to exchange of heat and the working fluid is evaporated to be vaporized.

If the temperature of the refrigerant of the electric part refrigerant passage pipes 120 is below 80° C., the temperature of the electric part refrigerant is decreased due to heat exchange and the working fluid is also evaporated to be vaporized.

Then, the working fluid evaporated in the heat pipe 140 rises through central/inner portions of the pipes 140, and the liquefied working fluid descends along the inner surfaces of the pipes 142 to return to the evaporation section. Some of the liquefied working fluid is vaporized and evaporated due to exchange of heat with the electric part refrigerant passage pipe 120 again, and some of the liquefied working fluid maintains a liquid state to flow to the evaporation section.

As the working fluid flows on the inner surface of the heat pipe 140 in a section where there is an increase in pipe thickness, it remains as a liquid at 55° C., and it exchanges heat with the electric part refrigerant.

When the temperature of the refrigerant of the engine refrigerant passage pipe 110 disposed above the electric part refrigerant passage pipe 120 is above 100°C, the temperature of the engine refrigerant is decreased due to exchange of heat, and the working fluid is vaporized to rise toward the condensation section.

The vaporized working fluid (in a gas state at 55° C.) that rises is exposed to the exterior air to be cooled and liquefied in the condensation section, and it consequently returns to the evaporation section.

For the above-described operation, in the multi-cooling module of the present invention, the engine refrigerant passage pipe 110, the electric part refrigerant passage pipe 120, and the condenser refrigerant passage pipe 130 can be stacked and arranged from top to bottom according the reference cooling temperatures of the refrigerants with respect to the front side of the vehicle. For example, the pipes may be stacked and arranged from top to bottom in order of the condenser refrigerant passage pipe 130, the electric part refrigerant passage pipe 120, and the engine refrigerant passage pipe 110 from the evaporation section (a lower portion of FIG. 3) to the heat radiation section of the heat pipe 140. The condensation section (an upper portion of FIG. 3) of the heat pipe 140 may in some embodiments be exposed to the exterior air to cool the working fluid being elevated in temperature.

Figure 4:
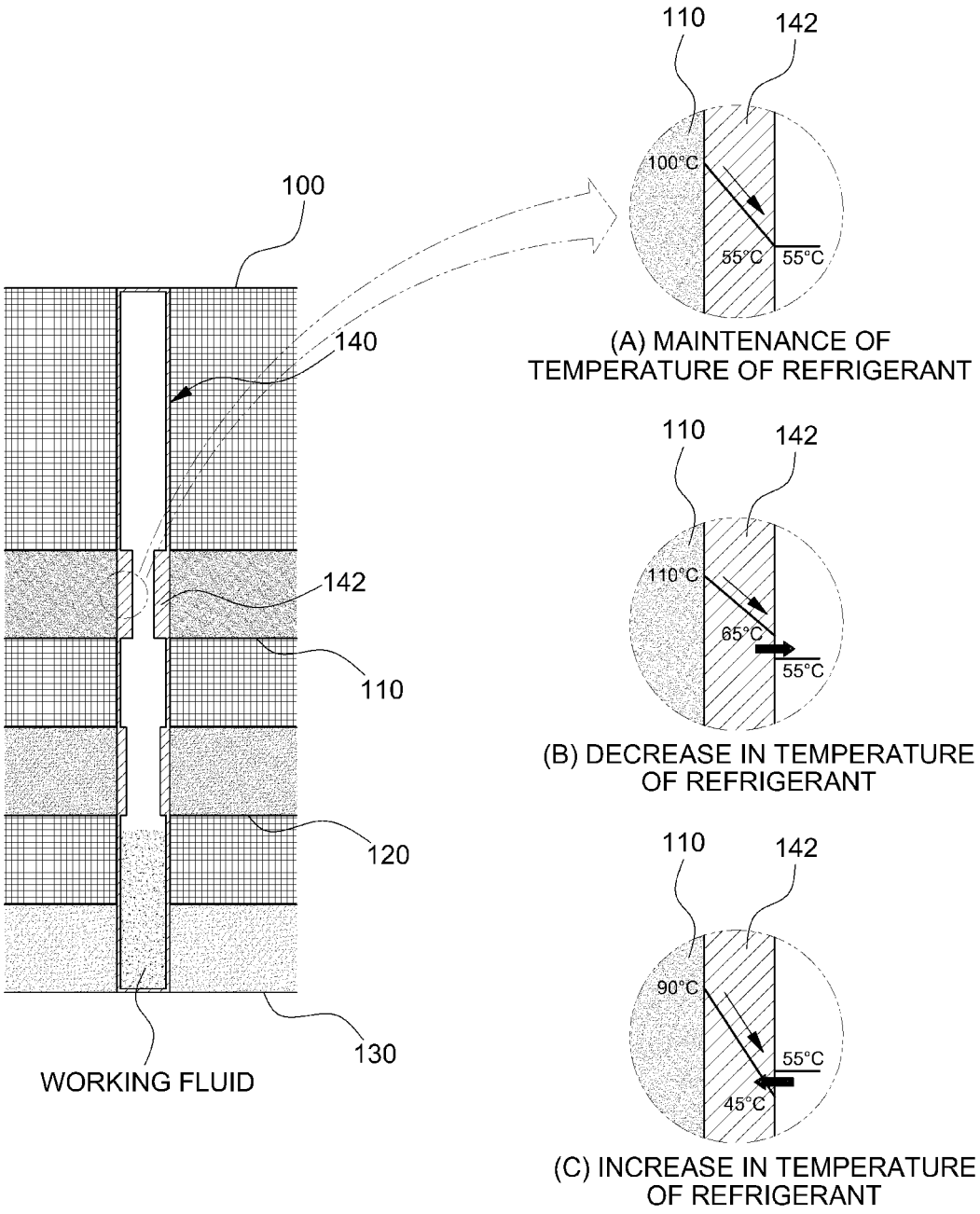
FIG. 4 illustrates operational states of the multi-cooling module for a vehicle according to an embodiment of the present invention.

Meanwhile, a heat exchanging process performed when the refrigerant of the heat exchanger (for example, an engine radiator) deviates from a reference cooling temperature will be described with reference to the embodiment depicted in FIG. 4.

When the temperature of the outer surface of the heat pipe 140 is a reference cooling temperature in a heat exchanging section where it exchanges heat with the engine refrigerant passage pipe 110, the heat pipe 140 of the present invention can employ a pipe thickness "d" by which the temperature of the inner surface (contact surface which comes into contact with the working fluid) becomes 55° C. (i.e., an evaporation temperature of the working fluid), where when the temperature of the engine refrigerant is 100° C., the temperature of the inner surface of the heat pipe 140 becomes 55° C. (i.e., the same temperature as the temperature of the liquid working fluid on the inner surface of the heat pipe 140) with the engine refrigerant maintaining the temperature state as in FIG. 4A.

Meanwhile, as illustrated in FIG. 4B, when the engine is insufficiently cooled, the temperature of the engine refrigerant exceeds 100° C., whereby the temperature of the inner surface of the heat pipe 140 exceeds the temperature of the working fluid (i.e., 55° C.), causing the temperature of the engine refrigerant to be decreased and the working fluid to be vaporized by heat exchange.

As illustrated in FIG. 4C, the temperature of the engine refrigerant may fall below 100° C., where the temperature of the inner surface of the heat pipe 140 falls below the temperature of the working fluid (i.e., 55° C.), causing the temperature of the engine refrigerant to be increased and the temperature of the working fluid to be decreased by heat exchange.

Meanwhile, a multi-cooling module for a vehicle according to another embodiment of the present invention will be described with reference to FIGS. 5 and 6.

Figure 5:
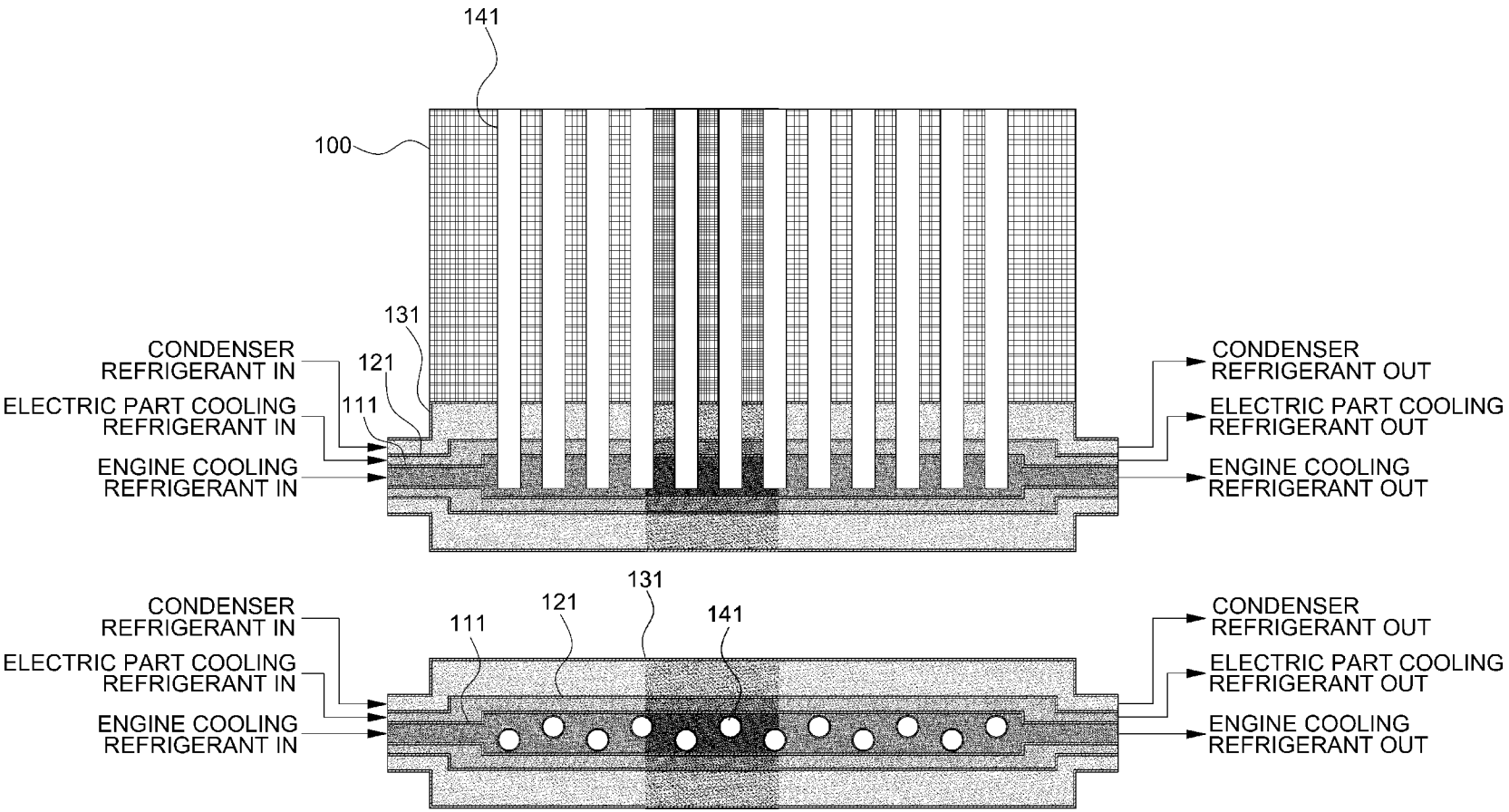
FIG. 5 is a schematic view illustrating a multi-cooling module for a vehicle according to another embodiment of the present invention.

As illustrated in FIG. 5, in the multi-cooling module for a vehicle, a plurality of heat pipes 141 are configured to vertically, and in some embodiments simultaneously, pass through an engine refrigerant passage pipe 111, an electric part refrigerant passage pipe 121, and a condenser refrigerant passage pipe 131, each of which are hollow.

In other words, as illustrated in FIG. 5, the heat pipes 141 are mounted so as to pass through the engine refrigerant passage pipe 111, the electric part refrigerant passage pipe 121, and the condenser refrigerant passage pipe 131, which are coaxially stacked and arranged in a cooling system core unit (or radiating fin core) 100. Refrigerants flowing within the interiors of the refrigerant passage pipes 111, 121, and 131 and passing by the outer surfaces of the heat pipes 141 can thus be cooled.

In particular, one of two refrigerant passage pipes selected from the engine refrigerant passage pipe 111, the electric part refrigerant passage pipe 121, and the condenser refrigerant passage pipe 131 can be inserted into the other of the two refrigerant passage pipes. The two selected refrigerant passage pipes are, in turn, inserted into the remaining refrigerant passage pipe to form a triple layer.

Figure 1:
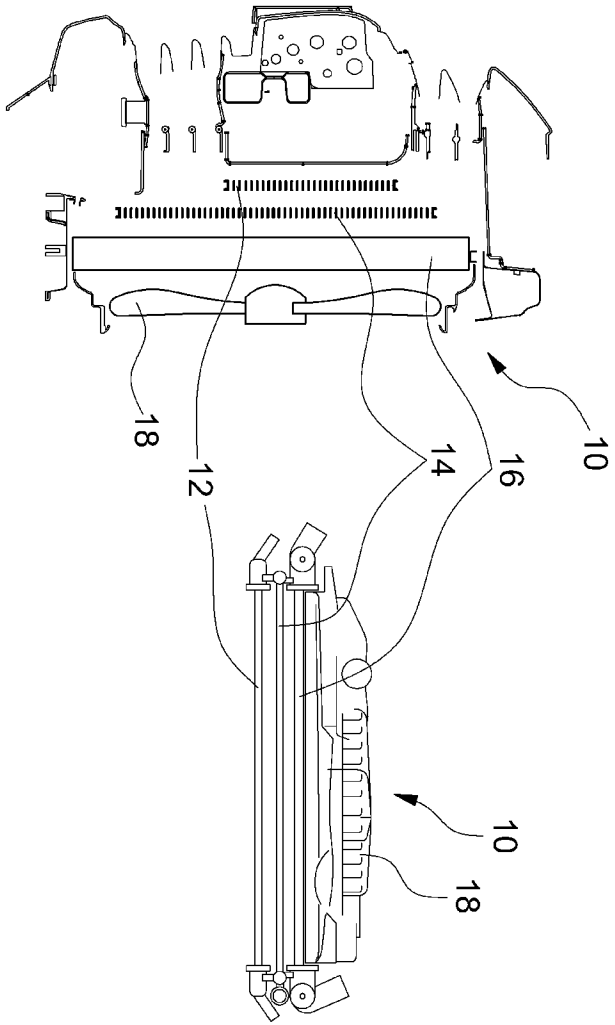
FIG. 1 is a view illustrating an arrangement of a conventional cooling apparatus for a hybrid vehicle.

As shown in FIG. 1, while an electric part radiator 12, a condenser 14, and an engine radiator 16 are conventionally disposed from front to back with respect to the front side of a vehicle, the engine refrigerant passage pipe 111, the electric part refrigerant pipe 121, and the condenser refrigerant passage pipe 131 are coaxially stacked and arranged such that they are disposed generally at the same position with reference to the front side of a vehicle according to the present invention.

In particular, the configuration of the refrigerant passage pipes 111, 121, and 131 will be further described considering the temperatures of the refrigerants flowing through their interiors. Engine cooling refrigerant, which has the highest temperature of the refrigerants, flows through the engine refrigerant passage pipe 111. Refrigerant passing through the electric part refrigerant passage pipe 121 has the second highest temperature. As such, the engine refrigerant passage pipe 111 is inserted into the electric part refrigerant passage pipe 121, and the electric part refrigerant passage pipe 121 is inserted into the condenser refrigerant passage pipe 131. Thus, the refrigerant passage pipes 111, 121, and 131 are sequentially arranged according to the temperatures of the refrigerants such that they are coaxially stacked. The structure is connected to the cooling system core unit 100, which is configured to support them.

It is understood that the cooling system core unit 100 has a structure through which exterior air can be introduced and discharged and can further have a plurality of heat radiating fins, to thereby increase or maximize the heat transfer effect by the heat pipes 141.

For example, heat radiating fins can be provided in the cooling system core unit 100, and can be configured to come into contact with the heat pipes 141 and the refrigerant passage pipes 111, 121, and 131.

As discussed herein, the refrigerant temperature refers to a temperature of a refrigerant introduced into one of the refrigerant passage pipes 111, 121, and 131 after cooling and being discharged from the engine, the electric parts, or the condenser.

In accordance with some embodiments, at least one heat pipe 141 simultaneously and vertically passes through the outer surfaces of the refrigerant passage pipes 111, 121, and 131 to simultaneously cool the engine cooling refrigerant, the electric part cooling refrigerant, and the condenser refrigerant through heat exchange of the working fluid. It is preferable that a plurality of heat pipes 141 are provided to increase heat exchange efficiency.

According to embodiments of the present invention, since the working fluid exchanges heat through phase changes within the heat pipes 141 as a thermal medium based on evaporation temperature (e.g. 55° C.), the refrigerant passage pipes 111, 121, and 131 are coaxially stacked in order (from the inside out) of the engine refrigerant passage pipe 111, the electric part refrigerant passage pipe 121, and the condenser refrigerant passage pipe 131 to simultaneously radiate heat of the refrigerants flowing therethrough. The temperature states and reference cooling temperatures to be restored differ, making it possible to effectively radiate heat of the refrigerants.

In other words, as mentioned above, the refrigerant passage pipes 111, 121, and 131 are sequentially and concentrically configured according to the temperatures of the refrigerants, thus making it possible to additionally radiate heat of the refrigerants passing through the refrigerant passage pipes 111 and 112, which are disposed on the inside of the refrigerants passing through the refrigerant passage pipes 121 and 131.

Figure 6:
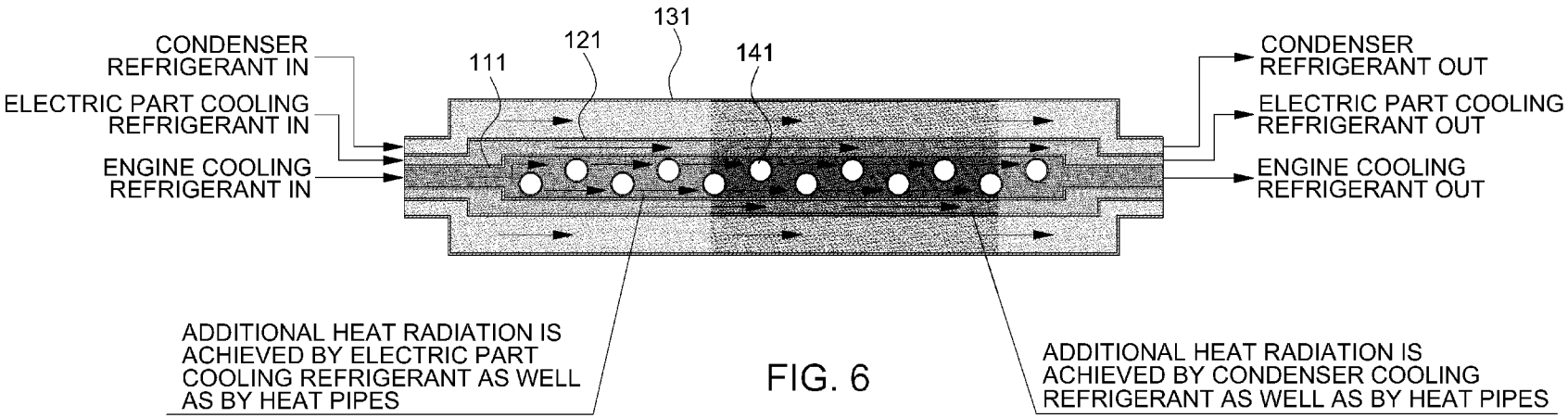
FIG. 6 illustrates operational states of the multi-cooling module for a vehicle according to another embodiment of the present invention.

For example, as illustrated in FIG. 6, for the engine cooling refrigerant, heat is radiated by the electric part cooling refrigerant which flows on the outer surface of the engine refrigerant passage pipe 111, as well as by the heat pipes 141. For the electric part refrigerant passage pipe 121, heat is radiated by the condenser refrigerant flowing on the outer surface of the electric part refrigerant passage pipe as well as the heat pipes 141.

The evaporation sections (which are generally at the lower sections near the refrigerant passage pipes 111, 121, 131) of the heat pipes 141 pass through the refrigerant passage pipes 111, 121, and 131 to allow heat exchanges of the refrigerants by the heat pipes 141. The refrigerant passage pipes 111, 121, and 131 are further situated so as to allow the refrigerants flowing therethrough to pass by the surfaces of the evaporation sections.

As illustrated in FIG. 5, the condensation sections (which are generally at the upper sections positioned away from the refrigerant passage popes 111, 121, 131) of the heat pipes 141 are exposed to exterior air through the cooling system core unit 100.

Hereinafter, the operational states of the multi-cooling module according to another embodiment of the present invention will be described.

Assuming that the working fluid within the heat pipes 141 is in a liquid state at or below 55 degrees Celsius, and the refrigerants (i.e. the engine cooling refrigerant, the electric part cooling refrigerant, and the condenser refrigerant) introduced into the refrigerant passage pipes 111, 121, and 131 have a temperature higher than that of the working fluid, the temperatures of the refrigerants are reduced by heat exchange with the working fluid while the refrigerants pass by the surfaces of the evaporation sections of the heat pipes 141.

Further, temperature reduction is achieved by the refrigerants of the refrigerant passage pipes 121 and 131 situated on the outside, in which case the temperature of the engine cooling refrigerant is additionally reduced by the electric part cooling refrigerant, and the temperature of the electric part cooling refrigerant is additionally reduced by the condenser refrigerant.

Temperature reduction is further achieved by the cooling system core unit 100, allowing all the refrigerants to effectively radiate heat.

The working fluid is then vaporized by heat exchange with the refrigerants flowing through the refrigerant passage pipes 111, 121, and 131, and the vaporized working fluid rises toward the condensation sections of the heat pipes 141.

The working fluid (which is assumed in this case to be in a gaseous state at 55 degrees Celsius), which has been vaporized and has risen, is then exposed to exterior air below 55 degrees Celsius in the condensation sections to thereby be cooled and liquefied. The liquefied working fluid consequently returns to the evaporation sections.

For the above-described operations, in the multi-cooling module of the present invention, the engine refrigerant passage pipe 111, the electric part refrigerant passage pipe 121, and the condenser refrigerant passage pipe 131 are configured according to the temperatures of the refrigerants flowing therethrough so as to be concentrically stacked and arranged, while further being penetrated by the evaporation sections of the heat pipes 141 so that the refrigerants can be cooled by the heat pipes 141.

In the multi-cooling module for a vehicle of the present invention, an engine refrigerant (engine cooling refrigerant), an electric part refrigerant (electric part cooling refrigerant), and a condenser refrigerant can be simultaneously cooled by one or more heat pipes 140 and 141. Further, one cooling system core unit 100 is sufficient, and the module can beneficially be installed within a restricted installation space.

According to the present invention, an area of an opening for the cooling efficiency of the vehicle does not need to be increased, making it possible to enhance the degree of freedom in design, to prevent increase in the volume of the cooling module, and to reduce manufacturing costs and weight.

Further, according to the present invention, the volume of the cooling fan does not need to be increased, thereby making it possible to enhance the charging/discharging performance.

Moreover, the multi-cooling module according to the present invention may be applied to various types of vehicles having more than three types of heat exchanges as well as hybrid vehicles, such as those listed in Table 1.

TABLE 1

| | Hybrid Vehicle | Gasoline Vehicle | Fuel Cell Vehicle | General Property |
|---|---|---|---|---|
| Heat Exchanger 1 | Engine Cooling Radiator Condenser | Engine Cooling Radiator Condenser | Stack Cooling Radiator Condenser | Heat Radiation Temperature: High |
| Heat Exchanger 2 | | | | Heat Radiation Temperature: Middle |
| Heat Exchanger 3 | Electric Part Cooling Radiator | None or Cooling of Oil | None or Cooling of Oil | Heat Radiation Temperature: Low |

The invention has been described in detail with reference to preferred embodiments thereof. However, it will be appreciated by those skilled in the art that changes may be made in these embodiments without departing from the principles and spirit of the invention, the scope of which is defined in the appended claims and their equivalents.

What is claimed is:

1. A multi-cooling module for a vehicle comprising:

one or more heat pipes;

two or more refrigerant passage pipes; and a cooling system core unit, wherein one or more heat pipes are disposed to pass through two or more refrigerant passage pipes which pass through the same cooling system core unit, and wherein each heat pipe has a different thickness at sections where the heat pipe passes through the two or more refrigerant passage pipes for heat exchange.

2. The multi-cooling module of claim 1, wherein the refrigerant passage pipes include an engine refrigerant passage pipe, an electric part refrigerant passage pipe, and a condenser refrigerant passage pipe.

3. The multi-cooling module of claim 2, wherein the refrigerant passage pipes are sequentially disposed in order from the hottest to the coldest.

4. The multi-cooling module of claim 1, wherein the refrigerant passage pipes are sequentially stacked and arranged from top to bottom in order of from a high temperature heat source to a low temperature heat source.

5. The multi-cooling module of claim 1, wherein the refrigerant passage pipes are sequentially disposed in order from the hottest to the coldest.

6. The multi-cooling module of claim 1, wherein the refrigerant passage pipes contain different refrigerants respectively.

7. The multi-cooling module of claim 1, wherein when temperatures of outer surfaces of the heat pipes are reference cooling temperatures of respective refrigerants, temperatures of inner surfaces of the heat pipes are an evaporation temperature of a working fluid provided in the heat pipes.

8. The multi-cooling module of claim 7, wherein each heat pipe has a different thickness at sections where the heat pipe passes through the refrigerant passage pipes for heat exchange.

9. The multi-cooling module of claim 1, wherein a plurality of heat pipes are configured in a multi-cooling module, and wherein each heat pipe has a different thickness at inlets and outlets of the respective refrigerant passage pipe.

10. A vehicle comprising the multi-cooling module of claim 1.

11. The vehicle of claim 10, wherein the vehicle is a hybrid vehicle.

12. A method for simultaneously cooling a vehicle engine, electric parts, and a condenser comprising using the multi-cooling module of claim 1 to cool through the one or more heat pipes.

* * * * *